US009255408B2

(12) United States Patent
Tanaka et al.

(10) Patent No.: US 9,255,408 B2
(45) Date of Patent: Feb. 9, 2016

(54) COLUMN STRUCTURE AND BASE MEMBER

(71) Applicant: Hitachi Metals Techno, Ltd., Koto-ku, Tokyo (JP)

(72) Inventors: Hidenori Tanaka, Tokyo (JP); Hideaki Takahashi, Tokyo (JP)

(73) Assignee: Hitachi Metals Techno, Ltd., Tokyo (JP)

( * ) Notice: Subject to any disclaimer, the term of this patent is extended or adjusted under 35 U.S.C. 154(b) by 0 days.

(21) Appl. No.: 14/345,946

(22) PCT Filed: Mar. 17, 2014

(86) PCT No.: PCT/JP2014/057079

§ 371 (c)(1),
(2) Date: Mar. 20, 2014

(87) PCT Pub. No.: WO2015/140889

PCT Pub. Date: Sep. 24, 2015

(65) Prior Publication Data

US 2015/0259913 A1 Sep. 17, 2015

(51) Int. Cl.

| | |
|---|---|
| ***E04C 3/32*** | (2006.01) |
| ***E02D 27/42*** | (2006.01) |
| ***E04H 12/22*** | (2006.01) |

(52) U.S. Cl.
CPC . *E04C 3/32* (2013.01); *E02D 27/42* (2013.01); *E04H 12/22* (2013.01)

(58) Field of Classification Search
CPC ..... E02D 27/42; E02D 27/00; E02D 27/50; E04C 3/32; E04C 3/30; E04H 12/22; E04H 12/2261; E04B 1/4157
USPC ..... 52/296, 297
See application file for complete search history.

(56) References Cited

U.S. PATENT DOCUMENTS

| | | | |
|---|---|---|---|
| 1,355,536 | A | 10/1920 | Caskey |
| 1,530,951 | A | 3/1925 | Krauss |

(Continued)

FOREIGN PATENT DOCUMENTS

| | | | |
|---|---|---|---|
| CN | 1873112 | A | 12/2006 |
| CN | 203188470 | U | 9/2013 |

(Continued)

OTHER PUBLICATIONS

Partial English language translation of the following: Office action dated May 19, 2015 from Japanese Patent Office in a Japanese patent application corresponding to the instant patent application.

(Continued)

*Primary Examiner* — Brian Glessner
*Assistant Examiner* — Adam Barlow
(74) *Attorney, Agent, or Firm* — Solaris Intellectual Property Group, PLLC

(57) ABSTRACT

In a column structure, a steel column having flanges integrally provided at both width direction ends of a web is welded to a base plate. The base plate is also fixed to first anchor bolts and to second anchor bolts, with the first anchor bolts and the second anchor bolts disposed at the opposite side of the flanges to the web. The second anchor bolts are also disposed at the web width direction inside with respect to the first anchor bolts. Therefore, load bearing ability of a column seat can be efficiently exhibited, and the thickness dimension of the base plate can be reduced.

10 Claims, 8 Drawing Sheets

(56) References Cited

U.S. PATENT DOCUMENTS

| | | | | |
|---|---|---|---|---|
| 2,610,708 | A | 9/1952 | Shannon | |
| 2,943,716 | A | 7/1960 | Babcock | |
| 3,918,229 | A * | 11/1975 | Schweinberger | E02D 27/14 52/295 |
| 4,048,776 | A * | 9/1977 | Sato | E04H 12/2261 248/188.1 |
| 4,136,811 | A * | 1/1979 | Sato | E04H 12/2261 228/165 |
| 4,571,913 | A | 2/1986 | Schleich | |
| 4,878,160 | A | 10/1989 | Reneau | |
| 4,965,974 | A | 10/1990 | LeBow | |
| 5,054,251 | A | 10/1991 | Kemeny | |
| 5,063,719 | A | 11/1991 | Matsuo et al. | |
| 5,274,971 | A | 1/1994 | Elmore | |
| 5,307,603 | A | 5/1994 | Chiodo | |
| 5,410,847 | A | 5/1995 | Okawa et al. | |
| 5,412,913 | A | 5/1995 | Daniels | |
| 5,426,267 | A | 6/1995 | Underhill et al. | |
| 5,444,951 | A | 8/1995 | Scott | |
| 5,467,567 | A | 11/1995 | Christensen | |
| 5,505,033 | A | 4/1996 | Matsuo | |
| 5,540,027 | A | 7/1996 | Christensen | |
| 5,678,382 | A * | 10/1997 | Naito | E02D 27/42 52/295 |
| 6,219,989 | B1 * | 4/2001 | Tumura | E04B 1/2403 52/274 |
| 6,438,904 | B1 | 8/2002 | Anzai | |
| 6,754,999 | B1 | 6/2004 | Urbanczvk | |
| 6,931,804 | B2 | 8/2005 | Trarup | |
| 7,647,742 | B2 | 1/2010 | Han | |
| 8,011,156 | B1 | 9/2011 | Schwan | |
| 8,037,651 | B2 * | 10/2011 | Dent | E02D 27/32 403/13 |
| 8,336,267 | B2 | 12/2012 | Montague | |
| 8,850,765 | B2 | 10/2014 | Amengual Pericas | |
| 8,955,283 | B2 | 2/2015 | Takagi | |
| 2002/0002806 | A1 | 1/2002 | Commins | |
| 2002/0066245 | A1 | 6/2002 | Pryor | |
| 2002/0095275 | A1 | 7/2002 | Anzai | |
| 2003/0009964 | A1 | 1/2003 | Trarup | |
| 2003/0196393 | A1 | 10/2003 | Bowman | |
| 2004/0040224 | A1 * | 3/2004 | Dayton | E04C 3/32 52/93.1 |
| 2004/0148903 | A1 | 8/2004 | Cash | |
| 2005/0120666 | A1 | 6/2005 | Alyea | |
| 2006/0048471 | A1 * | 3/2006 | Lee | E02D 27/00 52/296 |
| 2007/0209314 | A1 | 9/2007 | Vaughn | |
| 2007/0245674 | A1 * | 10/2007 | Hubbell | E01F 9/0117 52/633 |
| 2009/0272053 | A1 | 11/2009 | Dent | |
| 2009/0279959 | A1 | 11/2009 | Bakos | |
| 2010/0146890 | A1 | 6/2010 | Kristensen | |
| 2011/0154758 | A1 * | 6/2011 | Reyneveld | E02D 27/42 52/296 |
| 2012/0186168 | A1 | 7/2012 | Mcphee | |
| 2014/0069046 | A1 | 3/2014 | Cai | |
| 2014/0230365 | A1 * | 8/2014 | Hemphill | E04C 3/30 52/843 |
| 2014/0318033 | A1 | 10/2014 | Coordes | |

FOREIGN PATENT DOCUMENTS

| | | | |
|---|---|---|---|
| CN | 203452266 | U | 2/2014 |
| CN | 203531147 | U | 4/2014 |
| JP | H02-213540 | A | 8/1990 |
| JP | H04-052320 | A | 2/1992 |
| JP | H04-153427 | | 5/1992 |
| JP | H05-214731 | A | 8/1993 |
| JP | H05-346038 | A | 12/1993 |
| JP | H06-010408 | A | 1/1994 |
| JP | H06-010410 | A | 1/1994 |
| JP | H06-019147 | A | 1/1994 |
| JP | 2655774 | B2 | 9/1997 |
| JP | H09-264029 | A | 10/1997 |
| JP | H10-008555 | A | 1/1998 |
| JP | 2001-288815 | A | 10/2001 |
| JP | 2002-146923 | | 5/2002 |
| JP | 2002-322737 | A | 11/2002 |
| JP | 2002-339455 | A | 11/2002 |
| JP | 2002-364070 | | 12/2002 |
| JP | 2003-232078 | | 8/2003 |
| JP | 2003-239381 | A | 8/2003 |
| JP | 2004-176482 | A | 6/2004 |
| JP | 2005-016212 | A | 1/2005 |
| JP | 2006-125157 | A | 5/2006 |
| JP | 2008-144425 | A | 6/2008 |
| JP | 2008-280787 | A | 11/2008 |
| JP | 2009-024367 | A | 2/2009 |
| JP | 2009-062717 | A | 3/2009 |
| JP | 2009-256885 | A | 11/2009 |
| JP | 2009-275390 | A | 11/2009 |
| JP | 4570139 | B2 | 10/2010 |
| JP | 2011-012402 | A | 1/2011 |
| JP | 2011-247077 | A | 12/2011 |
| JP | 2012-007381 | A | 1/2012 |
| JP | 2012-007382 | A | 1/2012 |
| JP | 2013-64244 | | 4/2013 |
| JP | 2013-100673 | A | 5/2013 |
| TW | 174024 | | 12/1991 |
| TW | 541388 | B | 7/2003 |

OTHER PUBLICATIONS

Japanese Office Action dated May 19, 2015 in Japanese Patent Application No. 2014-513827.

Japanese Office Action dated May 19, 2015 in Japanese Patent Application No. 2014-513828.

U.S. Office Action dated May 7, 2015, issued against U.S. Appl. No. 14/345,947.

U.S. Office Action dated Oct. 31, 2014, issued against U.S. Appl. No. 14/345,948.

U.S. Office Action dated Apr. 17, 2015, issued against U.S. Appl. No. 14/345,948.

U.S. Office Action dated May 21, 2015, issued against U.S. Appl. No. 14/345,949.

U.S. Office Action dated Oct. 8, 2015, issued against U.S. Appl. No. 14/345,947.

U.S. Office Action dated Oct. 21, 2015, issued against U.S. Appl. No. 14/345,951.

English Translation of the Taiwanese Office Action dated Aug. 26, 2015 in the corresponding Taiwanese Patent Application No. 103109926.

* cited by examiner

COLUMN STRUCTURE AND BASE MEMBER

TECHNICAL FIELD

The present invention relates to a column structure with a column member joined to the upper side of a base member, and to a base member that has an upper side for joining to a column member.

BACKGROUND ART

In Japanese Patent No. 4570139, anchor bolts are anchored to a concrete foundation, a base plate is fixed to the anchor bolts at insertion holes, and a column member is fixed to an upper side of the base plate. The column member is configured from H-section steel integrally provided with flanges at both width direction sides of a web.

On the opposite side of the respective flanges to the web, there is a uniform distance in the web width direction to the respective flange from each of the anchor bolts and each of the insertion holes.

DISCLOSURE OF INVENTION

Technical Problem

In consideration of the above circumstances, an object of the present invention is to obtain a column structure capable of efficiently exhibiting load bearing ability in a column seat and capable of reducing a thickness dimension of a base member, and to obtain a base member capable of efficiently exhibiting load bearing ability in a column seat and capable of reducing a thickness dimension of a base body.

Solution to Problem

A column structure of a first aspect of the present invention includes: a column member that is integrally provided with a flange at each of two width direction sides of a web; a base member that has the column member joined to an upper side of the base member; a first anchor member including a lower end side to which a first anchor portion is attached with the lower end side anchored in concrete, and including an upper end side to which the base member is fixed at the opposite side of the flange to the web side; and a second anchor member including a lower end side to which a second anchor portion is attached with the lower end side anchored in concrete, and including an upper end side to which the base member is fixed at the flange width direction outside and at the web width direction inside of the first anchor member.

A second aspect of the present invention is column structure of the first aspect of the present invention, wherein the base member is fixed to the upper end side of the second anchor member at a width direction outside of the flange or at the web side of the flange.

A third aspect of the present invention is the column structure of the first aspect or the second aspect of the present invention, wherein the base member is fixed to the upper end side of the second anchor member at the flange width direction outside.

A fourth aspect of the present invention is the column structure of any one of the first aspect to the third aspect of the present invention, wherein an indented portion is provided in a lower side face of the base member.

A fifth aspect of the present invention is the column structure of any one of the first aspect to the fourth aspect of the present invention, wherein the base member includes: a base portion that is provided at each of the flange sides of the web; a connection portion that connects together the pair of base portions; and a pair of cutaway portions that are provided between the pair of base portions.

A sixth aspect of the present invention is the column structure of any one of the first aspect to the fourth aspect of the present invention, wherein there is one of the base members provided at each of the flange sides of the web, and a gap is provided between the base members.

A seventh aspect of the present invention is the column structure of the sixth aspect of the present invention, wherein a projection portion is provided at the base member and projects out to the web side of the flange underneath the web.

An eighth aspect of the present invention is a base member including: a base body that has an upper side for joining to a column member integrally provided with a flange at each of two width direction sides of a web; a first fixing portion that is provided at the base body at the opposite side of the flange to the web side, and is fixed to an upper end side of a first anchor member, the first anchor member including a lower end side to which a first anchor portion is attached with the lower end side anchored in concrete; and a second fixing member that is provided at the base body at the flange width direction outside and the web width direction inside of the first fixing portion, and is fixed to an upper end side of a second anchor member, the second anchor member including a lower end side to which a second anchor portion is attached with the lower end side anchored in concrete.

A ninth aspect of the present invention is the base member of the eighth aspect of the present invention, wherein the second fixing member is disposed at a width direction outside of the flange or at the web side of the flange.

A tenth aspect of the present invention is the base member of the eighth aspect or the ninth aspect of the present invention, wherein the second fixing member is disposed at the flange width direction outside.

An eleventh aspect of the present invention is the base member of any one of the eighth aspect to the tenth aspect of the present invention, wherein an indented portion is provided in a lower side face of the base body.

A twelfth aspect of the present invention is the base member of any one of the eighth aspect to the eleventh aspect of the present invention, wherein the base body includes: a base portion that is provided at each of the flange sides of the web; a connection portion that connects together the pair of base portions; and a pair of cutaway portions that are provided between the pair of base portions.

A thirteenth aspect of the present invention is the base member of any one of the eighth aspect to the eleventh aspect of the present invention, wherein there is one of the base bodies provided at each of the flange sides of the web, and a gap is provided between the base members.

A fourteenth aspect of the present invention is the base member of the thirteenth aspect of the present invention, wherein a projection portion is provided at the base body and projects out to the web side of the flange underneath the web.

Advantageous Effects of Invention

In the column structure of the first aspect of the present invention, the column member integrally provided with a flange at each of two width direction sides of the web is joined to the upper side of the base member. The first anchor member and the second anchor member have the first anchor portion and the second anchor portion attached to their respective lower end sides, and the lower end sides are anchored in concrete. The base member is fixed to the upper end side of the first anchor member at the opposite side of the flange to the web side, and the base member is fixed to the upper end side of the second anchor member at the flange width direction outside of the first anchor member.

The base member is fixed to the upper end side of the second anchor member at the web width direction inside of the first anchor member. Load bearing ability (load bearing ability with respect to bending moment) of a column seat (including the base member, the first anchor member and the second anchor member, that configure a bending moment transmission section from the column member to the concrete) can be efficiently exhibited. Moreover, the distance of the second anchor member to the web width direction outside with respect to the flange can be made small, enabling a reduction in the thickness dimension of the base member.

In the column structure of the second aspect of the present invention, the base member is fixed to the upper end side of the second anchor member at the width direction outside of the flange or at the web side of the flange. The load bearing ability of the column seat can accordingly be even effectively and efficiently exhibited. Moreover, the distance of the second anchor member to the web width direction outside with respect to the flange can be efficiently reduced, enabling the thickness dimension of the base member to be efficiently reduced.

In the column structure of the third aspect of the present invention, the base member is fixed to the upper end side of the second anchor member at the flange width direction outside. The load bearing ability of the column seat can accordingly be even more efficiently exhibited.

In the column structure of the fourth aspect of the present invention, the indented portion is provided in the lower side face of the base member. This thereby enables displacement of the base member in the horizontal direction to be suppressed.

In the column structure of the fifth aspect of the present invention, in the base member there is a base portion provided at each flange side, and a pair of base portions are connected together by the connection portion.

The cutaway portions are also provided between the pair of base portions. This thereby enables the weight of the base member to be reduced. Moreover, the load bearing ability of the column seat can be efficiently exhibited as before since the web is disposed between the pair of base portions.

In the column structure of the sixth aspect of the present invention, the base member is provided at each of the flange sides of the web, and the gap is provided between the pair of base portions. This thereby enables each of the base members to be made smaller, enabling the total weight of the pair of base portions to be reduced. Moreover, the load bearing ability of the column seat can be efficiently exhibited as before since the web is disposed between the pair of base members.

In the column structure of the seventh aspect of the present invention, the projection portion provided at the base member projects out to the web side of the flange below the web. This thereby enables the projection portion to be joined to the web, enabling the column member to be joined to the base member strongly.

In the base member of the eighth aspect of the present invention, the column member integrally provided with the flange at the two width direction sides of the web is joined to the upper side of the base body. Load bearing ability (load bearing ability with respect to bending moment) of a column seat (including the base member, the first anchor member and the second anchor member, that configure a bending moment transmission section from the column member to the concrete) can be efficiently exhibited. Moreover, in the base body, the first fixing portion is fixed to the upper end side of the first anchor member at the opposite side of the flange to the web side, and in the base body, the second fixing portion is fixed to the upper end side of the second anchor member at the flange width direction outside of the first fixing portion.

The second fixing portion is provided at the base body at the web width direction inside of the first fixing portion. This thereby enables a drop in the bending strength of the base body to be suppressed. Moreover, the distance of the second fixing portion toward the web width direction outside with respect to the flange can be reduced, enabling the thickness dimension of the base body to be reduced.

In the base member of the ninth aspect of the present invention, the second fixing portion is disposed at the width direction outside of the flange or at the web side of the flange. The load bearing ability of the column seat can accordingly be even effectively and efficiently exhibited. Moreover, the distance of the second fixing portion toward the web width direction outside with respect to the flange can be efficiently reduced, enabling the thickness dimension of the base body to be efficiently reduced.

In the base member of the tenth aspect of the present invention, the second fixing portion is disposed at the width direction outside of the flange. The load bearing ability of the column seat can accordingly be even more efficiently exhibited.

In the base member of the eleventh aspect of the present invention, the indented portion is formed to the lower side face of the base body. This thereby enables displacement of the base body in the horizontal direction to be suppressed.

In the base member of the twelfth aspect of the present invention, in the base body, there is the base portion provided at each of the flange sides of the web, and the pair of base portions are connected together by the connection portion.

The cutaway portions are provided between the pair of base portions. This thereby enables the weight of the base body to be reduced. Moreover, the load bearing ability of the column seat can be efficiently exhibited as before since the web is disposed between the pair of base portions.

In the base member of the thirteenth aspect of the present invention, the base body is provided at each of the flange sides of the web, and the gap is provided between the pair of base bodies. This thereby enables each of the base bodies to be made smaller, enabling the total weight of the pair of base bodies to be reduced. Moreover, the load bearing ability of the column seat can be efficiently exhibited as before since the web is disposed between the pair of base portions.

In the base member of the fourteenth aspect of the present invention, the projection portion provided at the base body projects out to the web side of the flange underneath the web. This thereby enables the web to be joined to the projection portion, enabling the column member to be joined to the base body strongly.

BEST MODE FOR CARRYING OUT THE INVENTION

First Exemplary Embodiment

Figure 1:
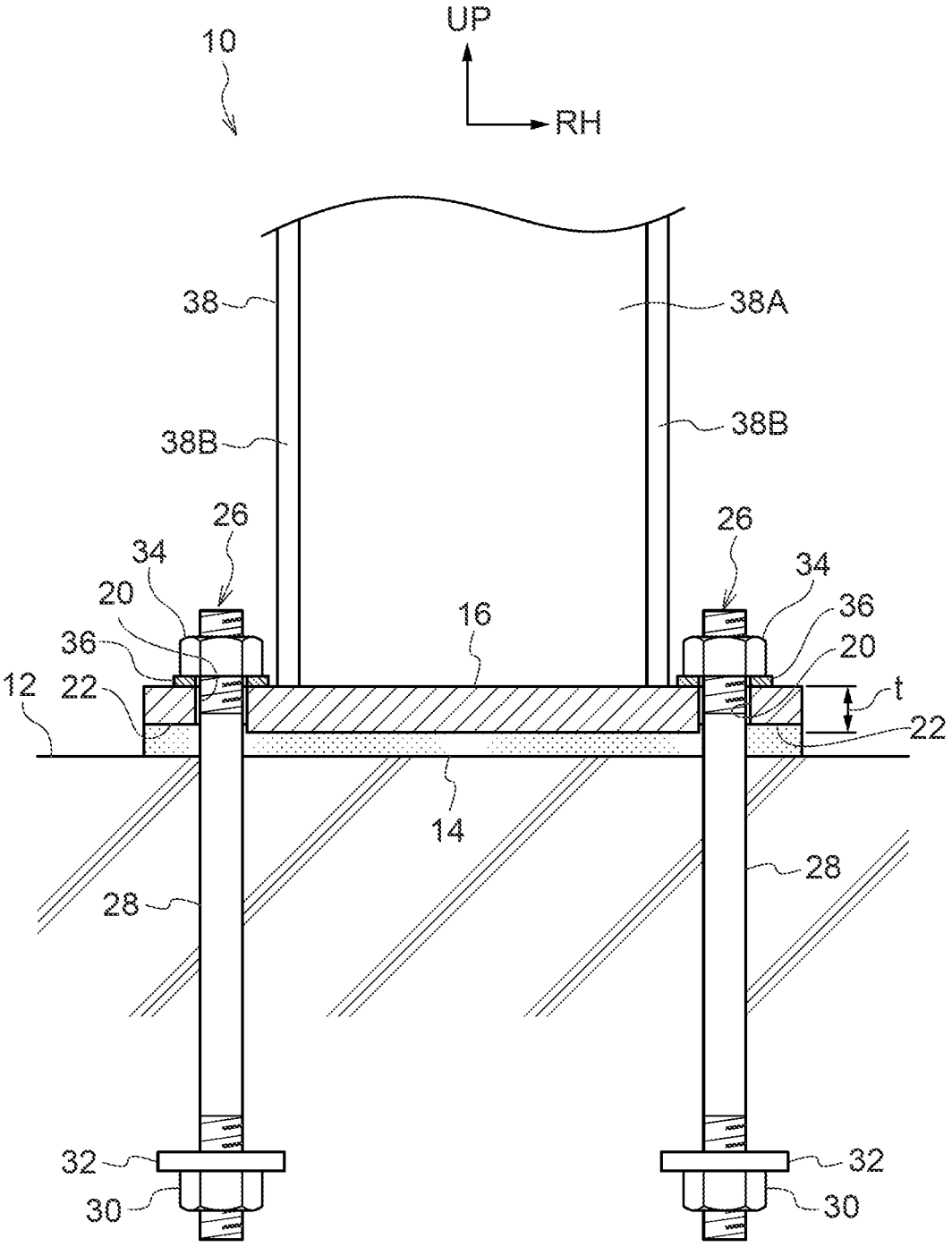
FIG. 1 is a cross-section view of a column structure according to a first exemplary embodiment of the present invention, as viewed from the front.
Figure 2:
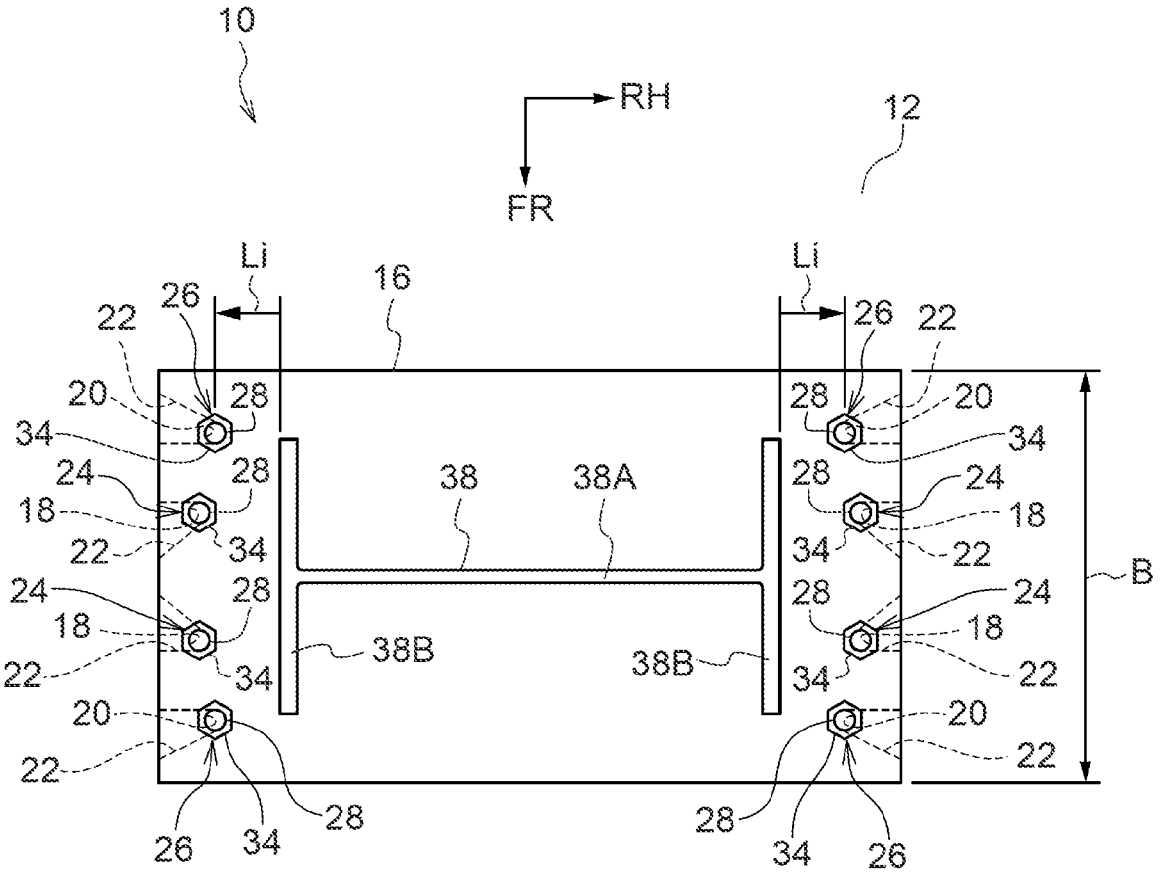
FIG. 2 is a plan view of a column structure according to the first exemplary embodiment of the present invention.

FIG. 1 illustrates a cross-section of a column structure 10 according to the first exemplary embodiment of the present invention, as viewed from the front; FIG. 2 illustrates a plan view of the column structure 10. Note that in the drawings the arrow FR indicates forward, the arrow RH indicates the right hand side, and the arrow UP indicates upward.

As illustrated in FIG. 1 and FIG. 2, the column structure 10 according to the present exemplary embodiment is set in foundation concrete 12 serving as concrete, with the upper face of the foundation concrete 12 in a flat plane shape, with the column structure 10 installed in an up-down direction perpendicular thereto.

Mortar 14 serving as fixing means is fixed to the upper face of the foundation concrete 12, and the mortar 14 is provided in a rectangular shape in plan view.

A metal base plate 16 serving as a base member and as a base body is fixed to the upper face of the mortar 14. The mortar 14 is disposed across the entire lower side of the base plate 16. The base plate 16 is formed in a rectangular plate shape, and the base plate 16 is disposed such that the length direction and width direction thereof are respectively parallel to the left-right direction and the front-rear direction, with the left-right direction dimension greater than the front-rear direction dimension.

A pair of circular shaped first fixing holes 18 that each serve as a first fixing portion is respectively formed at both a left hand side portion and a right hand side portion of the base plate 16, penetrating through a front-rear direction central side portion of the base plate 16, with the axial direction of the first fixing holes 18 parallel to the up-down direction. The left-right direction positions of the pair of first fixing holes 18 (the center axial lines thereof) on the left hand side, and the left-right direction positions of the pair of first fixing holes 18 (the center axial lines thereof) on the right hand side are respectively aligned with each other; the pair of first fixing holes 18 (the center axial lines thereof) on the left hand side, and the pair of first fixing holes 18 (the center axial lines thereof) on the right hand side are disposed symmetrically to each other about a perpendicular plane perpendicular to the left-right direction and passing through the left-right direction center of the base plate 16. The front-rear direction positions of the pair of first fixing holes 18 (the center axial lines thereof) at the front side, and the front-rear direction positions of the pair of first fixing holes 18 (the center axial lines thereof) at the rear side are respectively aligned with each other; the pair of first fixing holes 18 (the center axial lines thereof) at the front side, and the pair of first fixing holes 18 (the center axial lines thereof) at the rear side are disposed symmetrically to each other about a perpendicular plane perpendicular to the front-rear direction and passing through the front-rear direction center of the base plate 16.

A pair of circular shaped second fixing holes 20 that each serve as a second fixing portion are respectively formed at both the left hand side portion and the right hand side portion of the base plate 16, penetrating through a front-rear direction outside portion of the base plate 16, with the axial direction of the second fixing holes 20 parallel to the up-down direction. The left-right direction positions of the pair of second fixing holes 20 (the center axial lines thereof) on the left hand side, and the left-right direction positions of the pair of second fixing holes 20 (the center axial lines thereof) on the right hand side are respectively aligned with each other; the pair of second fixing holes 20 (the center axial lines thereof) on the left hand side and the pair of second fixing holes 20 (the center axial lines thereof) on the right hand side are disposed symmetrically to each other about a perpendicular plane perpendicular to the left-right direction and passing through the left-right direction center of the base plate 16. The front-rear direction positions of the pair of second fixing holes 20 (the center axial lines thereof) at the front side, and the front-rear direction positions of the pair of second fixing holes 20 (the center axial lines thereof) at the rear side are respectively aligned with each other; the pair of second fixing holes 20 (the center axial lines thereof) at the front side, and the pair of second fixing holes 20 (the center axial lines thereof) at the rear side are disposed symmetrically to each other about a perpendicular plane perpendicular to the front-rear direction and passing through the front-rear direction center of the base plate 16. The pair of second fixing holes 20 (the center axial lines thereof) on the left hand side are disposed further to the right hand side (to the base plate 16 left-right direction center side) than the pair of first fixing holes 18 (the center axial lines thereof) on the left hand side; the pair of second fixing holes 20 (the center axial lines thereof) on the right hand side are disposed further to the left hand side (to the base plate 16 left-right direction center side) than the pair of first fixing holes 18 (the center axial lines thereof) on the right hand side.

Indented portions 22 are formed to the lower face of the base plate 16 at the periphery of the first fixing holes 18 and the second fixing holes 20; the upper face (bottom face) of each of the indented portions 22 is a flat plane shape disposed perpendicular to the up-down direction. The indented portions 22 are formed in triangular shapes in plan view, with a width dimension that gradually increases on progression toward the outer peripheral side of the base plate 16, with the indented portion 22 open to the outside of the outer periphery of the base plate 16. The peripheral face of each of the indented portions 22 is disposed perpendicular to the horizontal direction, and the base plate 16 center side end peripheral face of each of the indented portion 22 is in the same plane as the peripheral face of the respective first fixing hole 18 or second fixing hole 20. The mortar 14 fills the whole of the indented portions 22, and the base plate 16 is anchored in the horizontal direction to the mortar 14 by the peripheral faces of the indented portions 22.

Two pairs each of first anchor bolts 24 serving as first anchor members and second anchor bolts 26 serving as second anchor members are respectively fixed to the foundation concrete 12; the first anchor bolts 24 and the second anchor bolts 26 are configured similarly to each other.

Circular rod shape anchor bodies 28 are respectively provided at the first anchor bolts 24 and the second anchor bolts 26, with the anchor bodies 28 disposed with their axial directions parallel to the up-down direction, and with portions of the anchor bodies 28 other than an upper end portion buried in the foundation concrete 12, with the upper end portion penetrating the mortar 14.

An anchor nut 30 that has a multifaceted tube shaped external profile and configures a first anchor portion or a second anchor portion is threaded coaxially on to a lower end portion of each of the anchor bodies 28; directly above the anchor nut 30, the lower end portion of each of the anchor bodies 28 passes coaxially through a circular ring plate-shaped fixing plate 32 that configures the first anchor portion or the second anchor portion. The anchor nut 30 and the fixing plate 32 are thereby attached to the lower end portion outer periphery of each of the anchor bodies 28. The anchor nut 30 and the fixing plate 32 protrude out to the radial direction outside of each of the anchor bodies 28 and are buried in the foundation concrete 12. The first anchor bolts 24 and the second anchor bolts 26 are thereby anchored in the up-down direction to the foundation concrete 12 by the anchor nut 30 and the fixing plate 32.

The upper end portion of the each of the anchor bodies 28 in the first anchor bolts 24 passes through the base plate 16 coaxially to the respective first fixing hole 18. The upper end portion of each of the anchor bodies 28 of the second anchor bolts 26 passes through the base plate 16 coaxially to the respective second fixing hole 20. A fixing nut 34 that has a multifaceted tube shaped external profile is threaded coaxially on to an upper end portion of each of the respective anchor bodies 28. Directly below the fixing nut 34, the upper end portion of each of the anchor bodies 28 passes coaxially through a circular ring plate-shaped washer 36. The fixing nut 34 and the washer 36 are thereby attached to the outer periphery of the upper end portion of each of the anchor bodies 28. Each of the washers 36 and the base plates 16 is clamped between the fixing nut 34 and the mortar 14, and the base plate 16 is fixed to the first anchor bolts 24 at the first fixing holes 18, and is fixed to the second anchor bolts 26 at the second fixing holes 20.

The lower end of a steel column 38 serving as a column member is welded (joined) to a central side portion of the upper face of the base plate 16, with the length direction of the steel column 38 disposed parallel to the up-down direction.

An elongated rectangular shaped web 38A is provided at the steel column 38. The web 38A is disposed at the base plate 16 front-rear direction center with its width direction disposed parallel to the left-right direction, with the width direction center of the web 38A aligned with the left-right direction center of the base plate 16. Elongated rectangular shaped flanges 38B are respectively integrally provided at the two width direction ends of the web 38A. The flanges 38B are disposed at the left hand side portion and the right hand side portion of the base plate 16, with their width directions parallel to the front-rear direction. The width direction center of each of the flanges 38B is connected to the web 38A, and the flanges 38B extend out forward and rearward of the web 38A. The steel column 38 is thereby configured with an H-shaped cross-section as viewed along the up-down direction.

At the left hand side portion and the right hand side portion of the base plate 16, the center axial lines of the first fixing holes 18, the second fixing holes 20, the first anchor bolts 24 and the second anchor bolts 26 are disposed on the opposite side of the flanges 38B to that of the web 38A. The center axial lines of the second fixing holes 20 and the second anchor bolts 26 are disposed to the web 38A width direction inside with respect to the center axial lines of the first fixing holes 18 and the first anchor bolts 24. The center axial lines of the first fixing hole 18 and the first anchor bolts 24 are disposed at the flanges 38B width direction inside, and the center axial lines of the second fixing holes 20 and the second anchor bolts 26 are disposed at the flanges 38B width direction outside.

There are plural of the column structures 10 provided for a building, and foundation beams (not illustrated in the drawings) span across between lower end portions of the steel columns 38 of adjacent column structures 10, so as to arrange the main foundation beam layout.

Explanation next follows regarding the operation of the present exemplary embodiment.

In the column structure 10 configured as above, the steel column 38 is welded to the upper face of the base plate 16, and in the steel column 38 the flanges 38B are integrally provided at the two width direction (left-right direction) ends of the web 38A. The base plate 16 is fixed by the first anchor bolts 24 at the first fixing holes 18, and fixed by the second anchor bolts 26 at the second fixing holes 20. At the left hand side portion and the right hand side portion of the base plate 16, the first anchor bolts 24 (the first fixing holes 18) and the second anchor bolts 26 (the second fixing holes 20) are disposed on the opposite side of the flanges 38B to the web 38A side.

However, generally the greater the total number of the first anchor bolts 24 and the second anchor bolts 26 (equivalent to the total number of the first fixing holes 18 and the second fixing holes 20), the greater the thickness dimension (up-down direction dimension) needs to be made for the base plate 16.

Moreover, at the left hand side portion or the right hand side portion of the base plate 16, the total number of the first anchor bolts 24 and the second anchor bolts 26 (equivalent to the total number of the first fixing hole 18 and the second fixing holes 20) is denoted n (4 in the present exemplary embodiment), the yield tensile strength in the axial direction of the $i^{th}$ first anchor bolt 24 or second anchor bolt 26 (the $i^{th}$ anchor body 28) is denoted Ti, and the separation distance from the flanges 38B toward the web 38A width direction outside of the center axial line of the $i^{th}$ first anchor bolt 24 or second anchor bolt 26 ($i^{th}$ anchor body 28) (equivalent to the center axial line of the $i^{th}$ first fixing hole 18 and the second fixing hole 20) is denoted Li. Furthermore, the front-rear direction dimension (width dimension) of the base plate 16 is denoted B, the thickness dimension of the base plate 16 is denoted t, and the yield point of the base plate 16 material is σ.

In this case the base plate 16 generally needs to satisfy the following Equation (1).

$$\sum_{i=1}^{n} T\ i\ L\ i \leq B(t^2/6)\ \sigma \qquad \text{Equation (1)}$$

At the left hand side portion and the right hand side portion of the base plate 16, the second anchor bolts 26 (the second fixing holes 20) are disposed to the web 38A width direction inside (the left-right direction central side of the base plate 16) with respect to the first anchor bolts 24 (the first fixing holes 18).

Thus even when a rotation moment acts in the web 38A width direction (left-right direction) on the steel column 38 about the lower end thereof, such as during an earthquake, bending deformation of the base plate 16 at the web 38A width direction outside can be suppressed by the first anchor bolts 24 and the second anchor bolts 26, and the load bearing ability (load bearing ability with respect to the bending moment) of the column seat (including the base plate 16, the mortar 14, the first anchor bolts 24 and the second anchor bolts 26 that configure a bending moment transmission section from the steel column 38 to the foundation concrete 12) can be efficiently exhibited.

Further, by reducing the separation distance Li of the center axial lines of the second anchor bolts 26 (the second fixing holes 20) toward the web 38A width direction outside with respect to the flanges 38B, the left hand side of Equation (1)

can be reduced, enabling the right hand side of Equation (1) to be reduced. The thickness dimension t of the base plate 16 can thereby be reduced.

Moreover, the first anchor bolts 24 (the first fixing holes 18) are disposed at the flanges 38B width direction inside, and the second anchor bolts 26 (the second fixing holes 20) are disposed at the flanges 38B width direction outside. Thus even when a rotation moment acts in the flanges 38B width direction (front-rear direction) on the steel column 38 about the lower end thereof, such as during an earthquake, bending deformation of the base plate 16 at the flanges 38B width direction outside can be suppressed by the first anchor bolts 24 and the second anchor bolts 26, enabling the load bearing ability of the column seat to be even more efficiently exhibited.

Moreover, the base plate 16 is anchored to the mortar 14 in the horizontal direction by the peripheral faces of the indented portions 22. Thus even when load acts on the base plate 16 in the horizontal direction, such as during an earthquake, displacement of the base plate 16 in the horizontal direction can be suppressed. This thereby enables the shear capacity of the steel column 38, the first anchor bolts 24, and the second anchor bolts 26 to be raised.

Second Exemplary Embodiment

Figure 3:
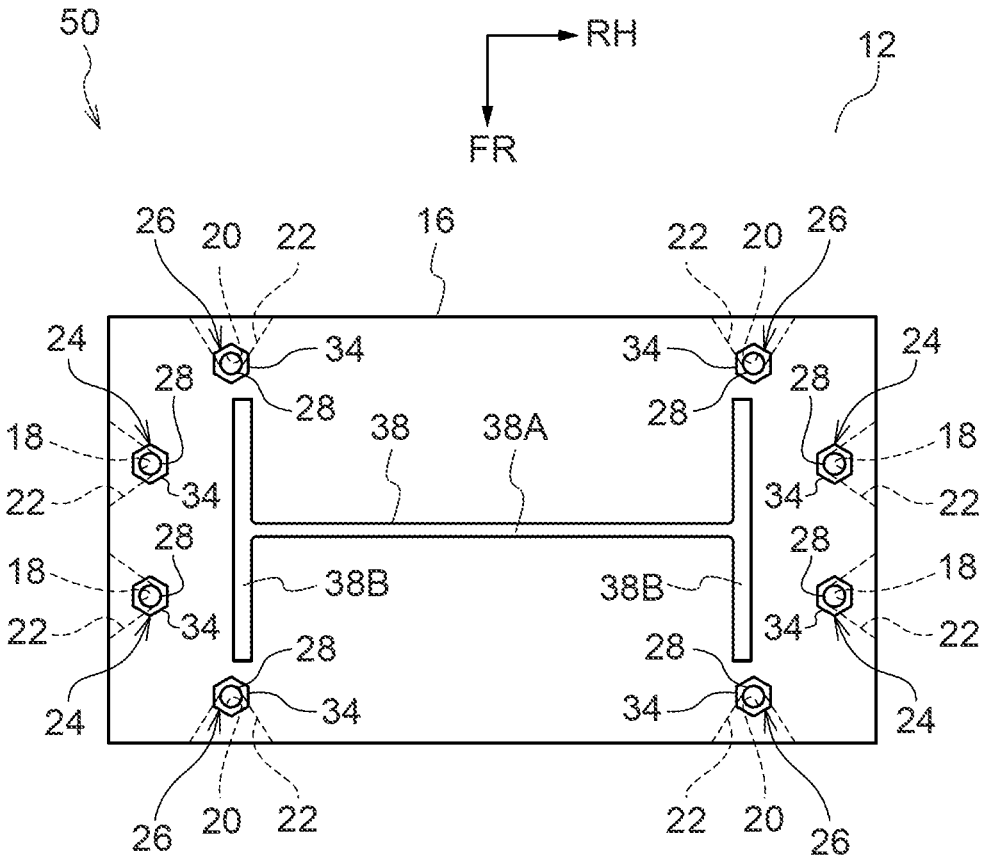
FIG. 3 is a plan view of a column structure according to a second exemplary embodiment of the present invention.

FIG. 3 is a plan view illustrating a column structure 50 according to the second exemplary embodiment of the present invention.

The column structure 50 according to the present exemplary embodiment is configured substantially the same as the first exemplary embodiment, but differs in the following points.

As illustrated in FIG. 3, in the column structure 50 according to the present exemplary embodiment, at the left hand side portion and the right hand side portion of the base plate 16, the center axial lines of the second fixing holes 20 and the second anchor bolts 26 are disposed at the flanges 38B width direction outside (positioned facing the flanges 38B in the flanges 38B width direction).

The present exemplary embodiment is capable of exhibiting similar operation and advantageous effects to those of the first exemplary embodiment.

In particular, at the left hand side portion and the right hand side portion of the base plate 16, the second anchor bolts 26 (the second fixing holes 20) are disposed at the flanges 38B width direction outside.

Thus even when a rotation moment acts in the web 38A width direction (left-right direction) on the steel column 38 about the lower end thereof, such as during an earthquake, bending deformation of the base plate 16 toward the web 38A width direction outside can be efficiently suppressed by the first anchor bolts 24 and the second anchor bolts 26, and the load bearing ability of the column seat can be effectively and efficiently exhibited.

Moreover, only the center axial lines of the first anchor bolts 24 (the first fixing holes 18) are disposed on the opposite side of the flanges 38B to the web 38A side, and since the center axial lines of the second anchor bolts 26 (the second fixing holes 20) are not disposed there, the left hand side of Equation (1) can be efficiently reduced, enabling the right hand side of Equation (1) to be reduced. This thereby enables the thickness dimension t of the base plate 16 to be efficiently reduced.

Moreover, the separation distance can be increased in the front-rear direction and the left-right direction between adjacent first anchor bolts 24 and second anchor bolts 26. This thereby enables easy layout of main foundation beams between the lower end portions of the steel column 38 for adjacent column structures 50 in a building, raising constructability.

Third Exemplary Embodiment

Figure 4:
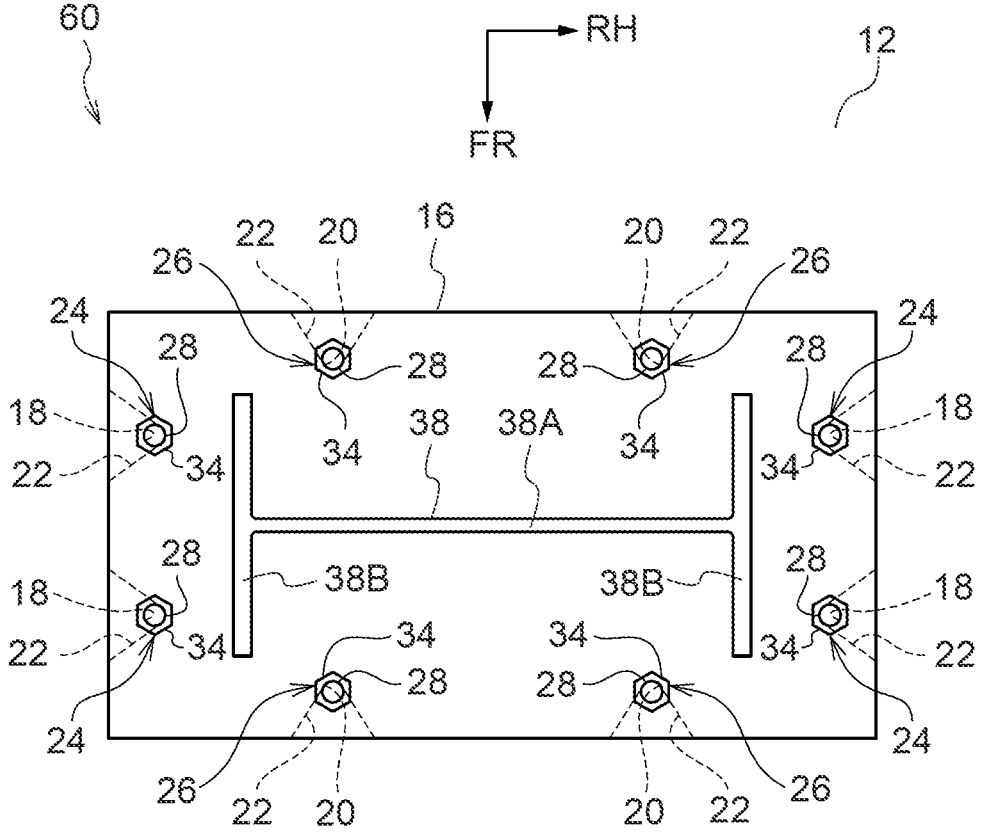
FIG. 4 is a plan view of a column structure according to a third exemplary embodiment of the present invention.

FIG. 4 illustrates a plan view of a column structure 60 according to a third exemplary embodiment of the present invention.

The column structure 60 according to the present exemplary embodiment is configured substantially the same as the first exemplary embodiment, but differs in the following points.

As illustrated in FIG. 4, in the column structure 60 according to the present exemplary embodiment, at the left hand side portion and the right hand side portion of the base plate 16, the separation distance in the front-rear direction between the pairs of first fixing holes 18 and between the pairs of first anchor bolts 24 is greater than in the first exemplary embodiment. Moreover, the center axial lines of the second fixing holes 20 and the second anchor bolts 26 are disposed to the web 38A side of the flanges 38B.

The present exemplary embodiment is capable of exhibiting the same operation and advantageous effects to those of the first exemplary embodiment.

In particular, at the left hand side portion and the right hand side portion of the base plate 16, the second anchor bolts 26 (the second fixing holes 20) are disposed to the web 38A side of the flanges 38B.

Thus even when a rotation moment acts in the web 38A width direction (left-right direction) on the steel column 38 about the lower end thereof, such as during an earthquake, bending deformation of the base plate 16 toward the web 38A width direction outside can be efficiently suppressed by the first anchor bolts 24 and the second anchor bolts 26, and the load bearing ability of the column seat can be effectively and efficiently exhibited.

Moreover, only the center axial lines of the first anchor bolts 24 (the first fixing holes 18) are disposed on the opposite side of the flanges 38B to the web 38A side, and since the center axial lines of the second anchor bolts 26 (the second fixing holes 20) are not disposed there, the left hand side of Equation (1) can be efficiently reduced, enabling the right hand side of Equation (1) to be reduced. This thereby enables the thickness dimension t of the base plate 16 to be efficiently reduced.

Moreover, the separation distance can be efficiently increased in the front-rear direction and the left-right direction between adjacent first anchor bolts 24 and the second anchor bolts 26. This thereby efficiently enables easy layout of main foundation beams between the lower end portions of the steel columns 38 of adjacent column structures 60 in a building, efficiently raising constructability.

Fourth Exemplary Embodiment

Figure 5:
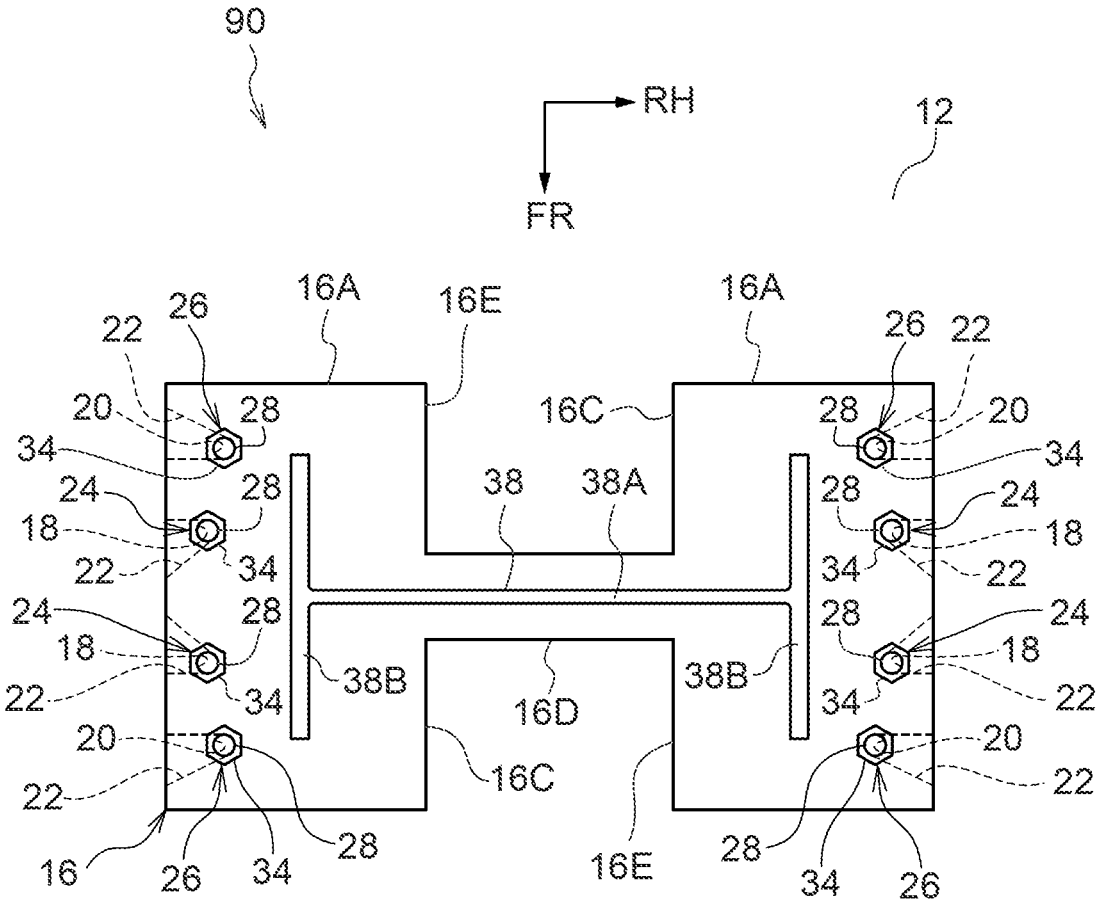
FIG. 5 is a plan view of a column structure according to a fourth exemplary embodiment of the present invention.

FIG. 5 illustrates a plan view of a column structure 90 according to a fourth exemplary embodiment of the present invention.

The column structure 90 according to the present exemplary embodiment is configured substantially the same as the first exemplary embodiment, but differs in the following points.

As illustrated in FIG. 5, in the column structure 90 according to the present exemplary embodiment, rectangular plate-shaped base portions 16A are respectively provided at the left hand side portion and the right hand side portion of the base plate 16, and a rectangular plate-shaped connection portion 16D is provided between the pair of base portions 16A. The mortar 14 is disposed across the entire lower side of the pair of base portions 16A and the connection portion 16D. The connection portion 16D is disposed with its length direction parallel to the left-right direction, connecting together the pair of base portions 16A. Cutaway portions 16E that are rectangular shaped in plan view are formed between the pair of base portions 16A at both width direction (front-rear direction) outsides of the connection portion 16D. The pair of base portions 16A, the connection portion 16D, and the pair of cutaway portions 16E are disposed symmetrically with respect to a perpendicular plane that is perpendicular to the left-right direction and passes through the left-right direction center of the base plate 16, and also symmetrically with respect to a perpendicular plane that is perpendicular to the front-rear direction and passes through the front-rear direction center of the base plate 16. The base plate 16 left-right direction center side portions of the base portions 16A configure projection portions 16C that are rectangular shaped in plan view.

In the steel column 38, the base portions 16A of the base plate 16 are disposed underneath each of the flanges 38B, and the lower side of the flanges 38B are welded to the upper face of the base portions 16A. The base portions 16A are configured with the projection portions 16C at the web 38A sides of the flanges 38B, and the projection portions 16C are disposed underneath the width direction end portions of the web 38A, with the lower ends of the web 38A width direction end portions welded to the upper face of the projection portions 16C. The connection portion 16D of the base plate 16 is disposed underneath the web 38A width direction center portion, and the lower end of the web 38A width direction center portion is welded to the upper face of the connection portion 16D. The front-rear direction position of the connection portion 16D width direction center is aligned with the front-rear direction position of the thickness direction center of the web 38A and, for example, the width direction dimension of the connection portion 16D is set at 3 to 5 times the thickness direction (front-rear direction) dimension of the web 38A.

The present exemplary embodiment is capable of exhibiting substantially the same operation and advantageous effects as those of the first exemplary embodiment.

Moreover, in the base plate 16, the base portions 16A are respectively provided at the left hand side portion and the right hand side portion, and the cutaway portions 16E are provided between the pair of base portions 16A.

This thereby enables the weight of the base plate 16 to be reduced, enabling an improvement in the utilization efficiency (yield) of material for the base plate 16.

Moreover, a drop in the load bearing ability of the portion of the column seat at the lower side of the web 38A is suppressed by the web 38A. The portion of the base plate 16 between the pair of base portions 16A only makes a minor contribution to the load bearing ability of the column seat, thereby enabling the load bearing ability of the column seat to be efficiently exhibited as before, even with the cutaway portions 16E provided between the pair of base portions 16A.

Moreover, the projection portions 16C of the base portions 16A project out further than the flanges 38B to the web 38A side underneath the web 38A, and the lower end of the web 38A width direction end portions are welded to the projection portions 16C. Moreover, underneath the web 38A, the connection portion 16D is connected to the pair of base portions 16A, and the lower end of the web 38A width direction center portion is welded to the connection portion 16D. This thereby enables the steel column 38 to be welded to the base plate 16 strongly.

Note that in the present exemplary embodiment, the cutaway portions 16E are rectangular plate-shaped in plan view. However, the cutaway portions 16E may be formed, for example, in triangular shapes in plan view, or in trapezoidal shapes in plan view. In such cases, the web 38A width direction dimension may be made to increase as the cutaway portions 16E progress out toward the flanges 38B width direction outside. Moreover, in such cases, the cutaway portions 16E may be provided only on the web 38A side of the flanges 38B, or the cutaway portions 16E may be provided on the opposite side of the flanges 38B to the web 38A side.

Moreover, in the present exemplary embodiment, the base portions 16A, the connection portion 16D, and the cutaway portions 16E have been provided at the base plate 16 of the first exemplary embodiment. However, the base portions 16A, the connection portion 16D, and the cutaway portions 16E may be provided at the base plate 16 of the second exemplary embodiment or the third exemplary embodiment.

Fifth Exemplary Embodiment

Figure 6:
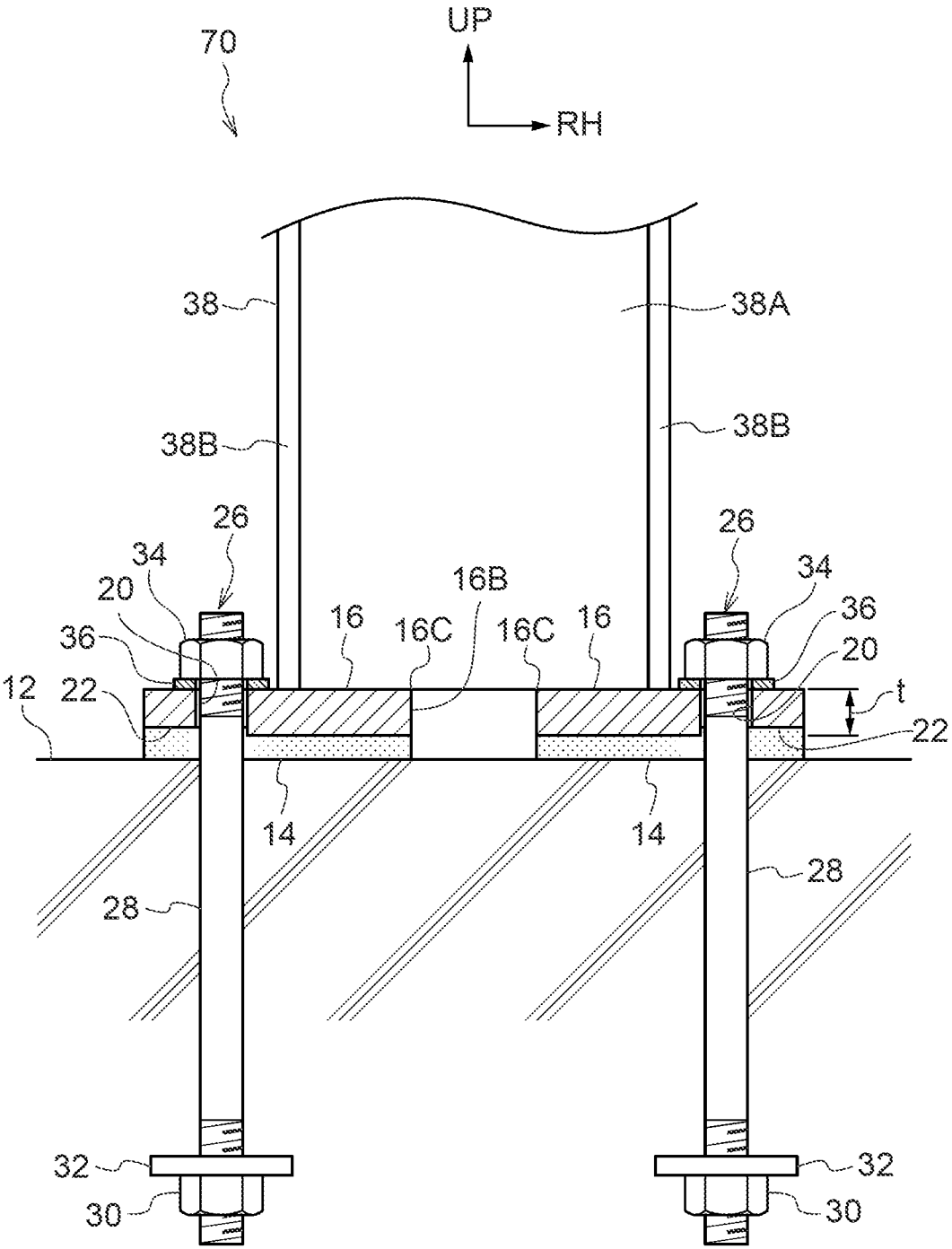
FIG. 6 is a cross-section view of a column structure according to a fifth exemplary embodiment of the present invention, as viewed from the front.
Figure 7:
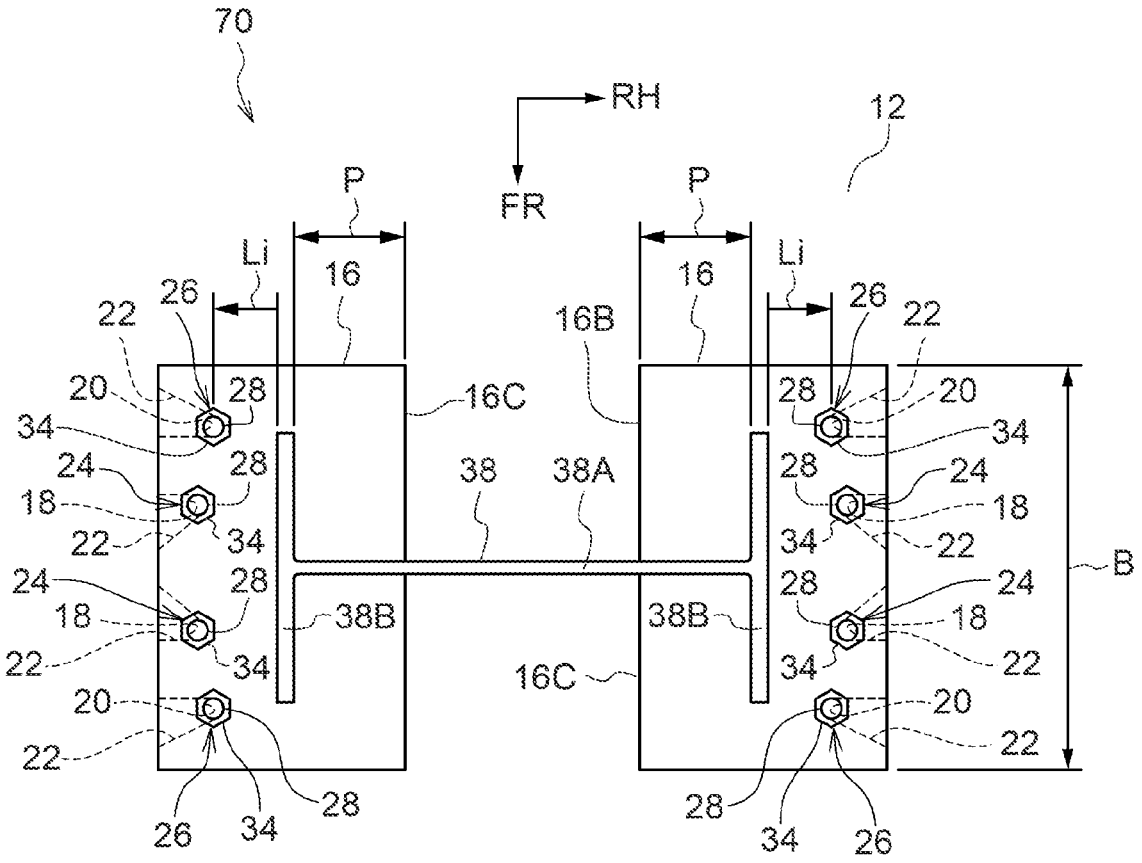
FIG. 7 is a plan view of a column structure according to the fifth exemplary embodiment of the present invention.

FIG. 6 illustrates a column structure 70 according to the fifth exemplary embodiment of the present invention, as viewed in cross-section from the front, and FIG. 7 illustrates a plan view thereof.

The column structure 70 according to the present exemplary embodiment is configured substantially the same as the first exemplary embodiment, but differs in the following points.

As illustrated in FIG. 6 and FIG. 7, in the column structure 70 according to the present exemplary embodiment, mortar 14 is provided on the left hand side and the right hand side, providing a pair of mortar 14 sections that are respectively rectangular shaped in plan view.

Base plates 16 that are respectively rectangular shaped in plan view are provided at the left hand side and the right hand side, with a gap 16B of rectangular shape in plan view provided between the pair of base plates 16. The mortar 14 on the left hand side and the right hand side is disposed across the entire lower side of the left hand side and the right hand side base plates 16. The pair of base plates 16 and the gap 16B are disposed symmetrically to each other about a perpendicular plane perpendicular to the left-right direction and passing through the left-right direction center of the pair of base plates 16, and symmetrically to each other about a perpendicular plane perpendicular to the front-rear direction and passing through the front-rear direction center of the pair of base plates 16. Moreover, plan view rectangular shaped projection portions 16C are formed at gap 16B side portions of the base plates 16. Moreover, the plan view profile and size of the pair of base plates 16 and the gap 16B are similar to the plan view profile and size of the base plate 16 in the first exemplary embodiment, and at the left hand side portion and the right hand side portion of the base plates 16, similar pairs of first fixing holes 18 and pairs of second fixing holes 20 to those formed in the left hand side portion and the right hand side portion of the base plate 16 of the first exemplary embodiment are respectively formed in the left hand side and the right hand side base plates 16.

In the steel column 38, the base plates 16 are disposed underneath each of the flanges 38B, and the lower ends of the flanges 38B are welded to the upper face of the base plates 16. In the base plates 16, projection portions 16C are configured at the web 38A sides of the flanges 38B, and the projection portions 16C are disposed underneath the width direction end portions of the web 38A, and the lower ends of the width direction end portions of the web 38A are welded to the upper face of the projection portions 16C. The gap 16B between the pair of base plates 16 is disposed underneath the width direction center portion of the web 38A, and the lower end of the width direction center portion of the web 38A is not welded to the base plate 16.

The present exemplary embodiment is capable of exhibiting similar operation and advantageous effects to those of the first exemplary embodiment Moreover, the base plates 16 are provided underneath each of the flanges 38B, and the gap 16B is provided between the pair of base plates 16.

Thus the size in plan view of each of the base plates 16 can be reduced, enabling the total weight of the pair of base plates 16 to be reduced, and enabling an improvement in the utilization efficiency (yield) of material for the pair of base plates 16.

Moreover, due to the web 38A being disposed between the pair of base plates 16, even suppose a single base plate 16 were to be present across the entire lower side of the steel column 38, a drop in the load bearing ability of the lower side portion of the web 38A of the column seat would be suppressed by the web 38A. The portion between the pair of base plates 16 only makes a minor contribution to the load bearing ability of the column seat, thereby enabling the load bearing ability of the column seat to be efficiently exhibited as before, even with the gap 16B provided between the pair of base plates 16.

Moreover, the projection portions 16C of the base plate 16 project out further to the web 38A side than the flanges 38B underneath the web 38A, and the lower ends of the width direction end portions of the web 38A are welded to the projection portions 16C. This thereby enables the steel column 38 to be welded to the base plate 16 strongly.

Moreover, if the separation distance in the web 38A width direction of the center axial lines of the second anchor bolts 26 (anchor bodies 28) (equivalent to the center axial line of the second fixing holes 20) with respect to the flanges 38B is Li, and the web 38A width direction dimension of the projection portions 16C is denoted P, then preferably:

$$2Li \leq P \leq 4Li \qquad \text{Equation (2)}$$

is satisfied.

So doing enables stress to be efficiently transmitted between the first anchor bolts 24 and the second anchor bolts 26, and the base plates 16 and the steel column 38. Moreover, in contrast to when $P<2Li$, it is possible to lower the possibility of a bending moment generated in the base plate 16 arising from the tensional force on the base plates 16 from the first anchor bolts 24 and the second anchor bolts 26, for example during an earthquake, having an adverse effect on the flanges 38B. Moreover, in contrast to when $P>4Li$, it is possible to lower the possibility that the projection portions 16C of the pair of base plates 16 cause interference due to the large web 38A width direction dimension P of the projection portions 16C. Moreover, even without making $P>4Li$, it is still possible to obtain sufficient efficiency in the transmission of stress between the first anchor bolts 24 and the second anchor bolts 26, and the base plates 16 and the steel column 38.

Sixth Exemplary Embodiment

Figure 8:
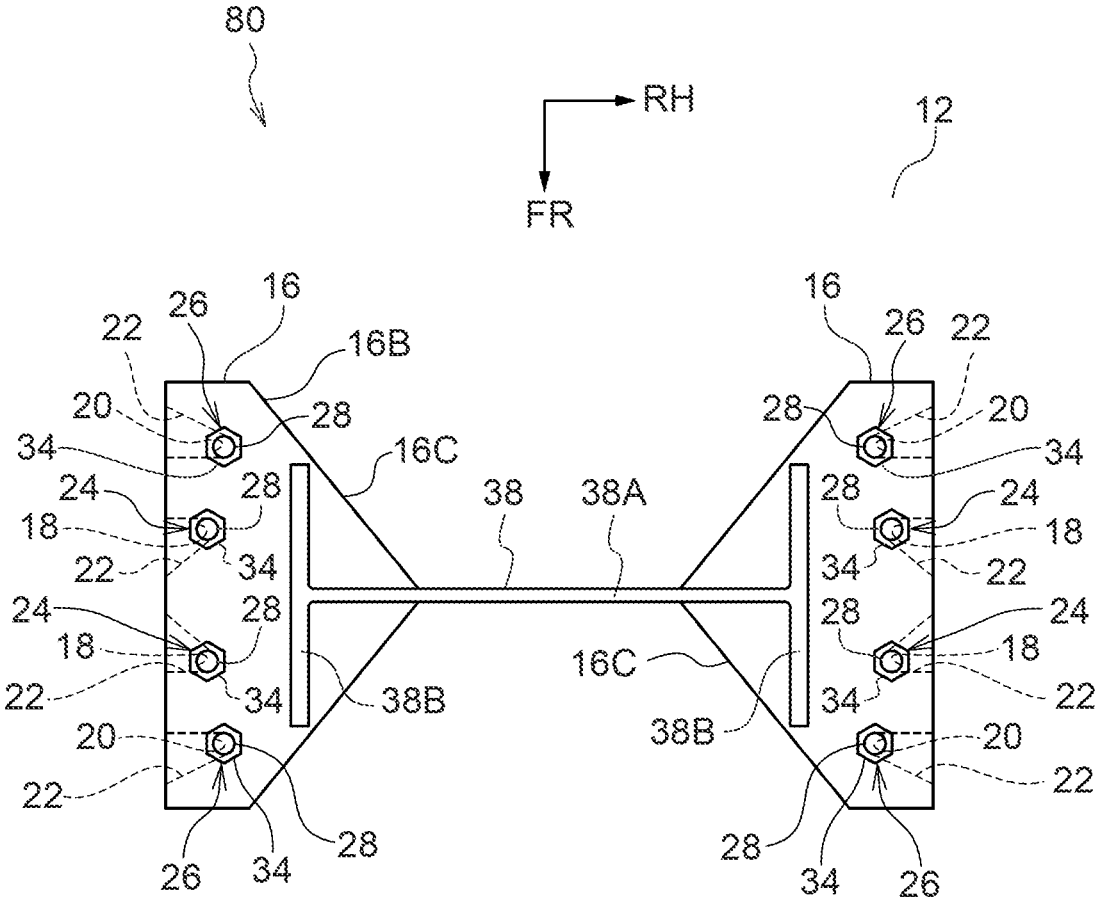
FIG. 8 is a plan view of a column structure according to a sixth exemplary embodiment of the present invention.

FIG. 8 illustrates a plan view of a column structure 80 according to a sixth exemplary embodiment of the present invention.

The column structure 80 according to the present exemplary embodiment is configured substantially the same as the fifth exemplary embodiment, but differs in the following points.

As illustrated in FIG. 8, in the column structure 80 according to the present exemplary embodiment, the left hand side and the right hand side base plates 16 are configured with plan view isosceles triangular shaped portions at web 38A width direction (left-right direction) inside portions of the base plates 16. The web 38A width direction inside ends of the base plates 16 (the leading end of projection portions 16C) are disposed underneath the web 38A. The flanges 38B width direction (front-rear direction) dimension of the base plates 16 accordingly gradually decreases on progression from the portion further to the web 38A width direction outside than the projection portions 16C toward the web 38A width direction inside. A gap 16B gradually increases in web 38A width direction dimension on progression toward the flanges 38B width direction outside.

The present exemplary embodiment is capable of exhibiting similar operation and advantageous effects to those of the fifth exemplary embodiment.

In particular, at the left hand side and the right hand side base plates 16, due to forming the plan view isosceles triangular shaped portions at the web 38A width direction inside portions of the base plates 16, not only are the projection portions 16C made smaller and the gap 16B larger, but the gap 16B is also formed as far as the opposite side of the flanges 38B to the web 38A side. This thereby enables the total weight of the pair of base plates 16 to be reduced further, thereby enabling further improvement to the utilization efficiency (yield) of material for the pair of base plates 16.

Note that in the present exemplary embodiment the gap 16B is provided all the way up to the opposite side of the flanges 38B to the web 38A side. However, the gap 16B may be provided only on the web 38A side of the flanges 38B.

Moreover, in the fifth exemplary embodiment and the sixth exemplary embodiment, the center axial lines of the second fixing holes 20 and the second anchor bolts 26 are disposed on the opposite side of the flanges 38B to the web 38A side. However, the center axial lines of the second fixing holes 20 and the second anchor bolts 26 may be disposed on the flanges 38B width direction outside (positioned facing the flanges 38B along the flanges 38B width direction), or may be disposed on the web 38A side of the flanges 38B.

By adopting this approach, even when a rotation moment acts in the web 38A width direction (left-right direction) on the steel column 38 about the lower end thereof, such as during an earthquake, bending deformation of the base plates 16 toward the web 38A width direction outside can be efficiently suppressed by the first anchor bolts 24 and the second anchor bolts 26, and the load bearing ability of the column seat can be effectively and efficiently exhibited.

Moreover, due to only the center axial lines of the first anchor bolts 24 (the first fixing holes 18) being disposed on the opposite side of the flanges 38B to the web 38A side, and the center axial lines of the second anchor bolts 26 (the second fixing holes 20) not being disposed there, the left hand side of Equation (1) can be efficiently made smaller, enabling the right hand side of Equation (1) to be efficiently made small. This thereby enables the thickness dimension t of the base plate 16 to be efficiently made smaller.

Moreover, the separation distance can be made greater in the front-rear direction and the left-right direction between adjacent first anchor bolts 24 and the second anchor bolts 26. This thereby enables easy layout of main foundation beams between the lower end portions of the steel columns 38 of adjacent column structures 70, 80 in a building, enabling constructability to be raised.

Moreover, in the first exemplary embodiment to the sixth exemplary embodiment, the center axial lines of the first fixing holes 18 and the first anchor bolts 24 are disposed to the width direction inside of the flanges 38B. However, the center axial lines of the first fixing holes 18 and the first anchor bolts 24 may be disposed at the width direction outside of the flanges 38B.

Moreover, in the first exemplary embodiment to the sixth exemplary embodiment, the center axial lines of the second fixing holes 20 and the second anchor bolts 26 are disposed at the width direction outsides of the flanges 38B. However, the center axial lines of the second fixing holes 20 and the second anchor bolts 26 may be disposed at the width direction inside of the flanges 38B.

In the first exemplary embodiment to the sixth exemplary embodiment, there is a pair of first fixing holes 18 and the first anchor bolts 24 respectively provided at either the left hand side portion and the right hand side portion of the base plate 16, or to the pair of base plates 16. However, it is sufficient for 1 or 3 or more of the first fixing holes 18 and the first anchor bolts 24 to be respectively provided at at least one out of the left hand side portion or the right hand side portion of the base plate 16, or to at least one of the pair of base plates 16.

Moreover, in the first exemplary embodiment to the sixth exemplary embodiment, there are a pair of second fixing holes 20 and the second anchor bolts 26 respectively provided at either of the left hand side portion and the right hand side portion of the base plate 16, or to the pair of base plates 16. However, it is sufficient for 1 or 3 or more of the second fixing holes 20 and the second anchor bolts 26 to be respectively provided at at least one out of the left hand side portion or the right hand side portion of the base plate 16, or to at least one of the pair of base plates 16.

Moreover, in the first exemplary embodiment to the sixth exemplary embodiment, the first anchor bolts 24 and the second anchor bolts 26 are anchored into the same foundation concrete 12. However the first anchor bolts 24 and the second anchor bolts 26 may be anchored to separate blocks of foundation concrete 12.

The invention claimed is:

1. A column structure comprising:

a column member that is integrally provided with a flange at each of two sides of a web in a width direction of the web;

a base member having an upper side to which the column member is joined;

a first anchor member including a lower end side to which a first anchor portion is attached with the lower end side anchored in concrete, and including an upper end side to which the base member is fixed at an opposite side of the flange from the web; and a second anchor member including a lower end side to which a second anchor portion is attached with the lower end side anchored in concrete, and including an upper end side to which the base member is fixed at a position further from the web than the first anchor member in a direction orthogonal to the width direction of the web, and at a position closer to the flange than the first anchor member in the width direction of the web, wherein the base member is fixed to the upper end side of the second anchor member at an outer side of the flange in the width direction of the web.

2. The column structure of claim 1, wherein an indented portion is provided in a lower side face of the base member.

3. A column structure comprising:

a column member that is integrally provided with a flange at each of two sides of a web in a width direction of the web;

a base member having an upper side to which the column member is joined;

a first anchor member including a lower end side to which a first anchor portion is attached with the lower end side anchored in concrete, and including an upper end side to which the base member is fixed at an opposite side of the flange from the web; and a second anchor member including a lower end side to which a second anchor portion is attached with the lower end side anchored in concrete, and including an upper end side to which the base member is fixed at a position further from the web than the first anchor member in a direction orthogonal to the width direction of the web, and at a position closer to the flange than the first anchor member in the width direction of the web, wherein the base member comprises:

a base portion that is provided at each of the flange sides of the web;

a connection portion that connects together a pair of the base portions; and cutaway portions that are provided between the pair of the base portions.

4. A column structure comprising:

a column member that is integrally provided with a flange at each of two sides of a web in a width direction of the web;

a base member having an upper side to which the column member is joined;

a first anchor member including a lower end side to which a first anchor portion is attached with the lower end side anchored in concrete, and including an upper end side to which the base member is fixed at an opposite side of the flange from the web; and a second anchor member including a lower end side to which a second anchor portion is attached with the lower end side anchored in concrete, and including an upper end side to which the base member is fixed at a position further from the web than the first anchor member in a direction orthogonal to the width direction of the web, and at a position closer to the flange than the first anchor member in the width direction of the web, wherein one base member is provided at each of the flange sides of the web, and a gap is provided between the base members.

5. The column structure of claim 4, wherein a projection portion is disposed at each base member and projects out to a web side of the flange underneath the web.

6. A base member comprising:

a base body that has an upper side configured to be joined to a column member that is integrally provided with a flange at each of two sides of a web in a width direction of the web;

a first fixing portion that is provided at the base body at an opposite side of the flange from the web, and that is fixed to an upper end side of a first anchor member, the first anchor member including a lower end side to which a first anchor portion is attached with the lower end side anchored in concrete; and a second fixing portion that is provided at the base body at a position further from the web than the first fixing portion in a direction orthogonal to the width direction of the web, and at a position closer to the flange than the first fixing portion in a width direction of the web, and that is fixed to an upper end side of a second anchor member, the second anchor member including a lower end side to which a second anchor portion is attached with the lower end side anchored in concrete, wherein the second fixing portion is disposed at an outer side of the flange in the width direction of the web.

7. The base member of claim 6, wherein an indented portion is provided in a lower side face of the base body.

8. A base member comprising:

a base body that has an upper side configured to be joined to a column member that is integrally provided with a flange at each of two sides of a web in a width direction of the web;

a first fixing portion that is provided at the base body at an opposite side of the flange from the web, and that is fixed to an upper end side of a first anchor member, the first anchor member including a lower end side to which a first anchor portion is attached with the lower end side anchored in concrete; and a second fixing portion that is provided at the base body at a position further from the web than the first fixing portion in a direction orthogonal to the width direction of the web, and at a position closer to the flange than the first fixing portion in a width direction of the web, and that is fixed to an upper end side of a second anchor member, the second anchor member including a lower end side to which a second anchor portion is attached with the lower end side anchored in concrete, wherein the base body comprises:

a base portion that is provided at each of the flange sides of the web;

a connection portion that connects together a pair of the base portions; and cutaway portions that are provided between the pair of the base portions.

9. A base member comprising:

a base body that has an upper side configured to be joined to a column member that is integrally provided with a flange at each of two sides of a web in a width direction of the web;

a first fixing portion that is provided at the base body at an opposite side of the flange from the web, and that is fixed to an upper end side of a first anchor member, the first anchor member including a lower end side to which a first anchor portion is attached with the lower end side anchored in concrete; and a second fixing portion that is provided at the base body at a position further from the web than the first fixing portion in a direction orthogonal to the width direction of the web, and at a position closer to the flange than the first fixing portion in a width direction of the web, and that is fixed to an upper end side of a second anchor member, the second anchor member including a lower end side to which a second anchor portion is attached with the lower end side anchored in concrete, wherein one base member is provided at each of the flange sides of the web, and a gap is provided between the base members.

10. The base member of claim 9, wherein a projection portion is disposed at the base member and projects out to a web side of the flange underneath the web.

* * * * *